US007165435B1

(12) United States Patent
Schroth et al.

(10) Patent No.: US 7,165,435 B1
(45) Date of Patent: Jan. 23, 2007

(54) CONDUCTION PREHEATING FOR HOT-FORMED SHEET METAL PANELS

(75) Inventors: James G. Schroth, Troy, MI (US); Richard H. Hammar, Utica, MI (US); Paul E. Krajewski, Sterling Heights, MI (US); Leonard L. Pollum, Lapeer, MI (US); Susan Elizabeth Hartfield-Wunsch, Livonia, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/189,112

(22) Filed: Jul. 25, 2005

(51) Int. Cl.
*C21D 1/34* (2006.01)
*C21D 11/00* (2006.01)

(52) U.S. Cl. ..... 72/364; 148/564

(58) Field of Classification Search ..... None
See application file for complete search history.

(56) References Cited

U.S. PATENT DOCUMENTS

| | | | | |
|---|---|---|---|---|
| 6,253,588 | B1 * | 7/2001 | Rashid et al. | 72/57 |
| 6,880,377 | B1 | 4/2005 | Kim et al. | |
| 6,886,383 | B1 | 5/2005 | Kim et al. | |
| 6,890,394 | B1 * | 5/2005 | Carsley et al. | 148/564 |

* cited by examiner

*Primary Examiner*—Lowell A. Larson
*Assistant Examiner*—Debra Wolfe
(74) *Attorney, Agent, or Firm*—Kathryn A. Marra

(57) ABSTRACT

Work hardened sheets of formable metal are annealed by thermal conduction and heated to a forming temperature. In a preferred embodiment, the sheet is placed on a flat surface of a heated lower platen to partially heat and soften the sheet and an opposing heated upper platen is brought close enough to the sheet to contribute heat but not to constrain the sheet as it expands. The platens are then both brought close to the sheet to heat it to its forming temperature largely by thermal conduction.

10 Claims, 2 Drawing Sheets

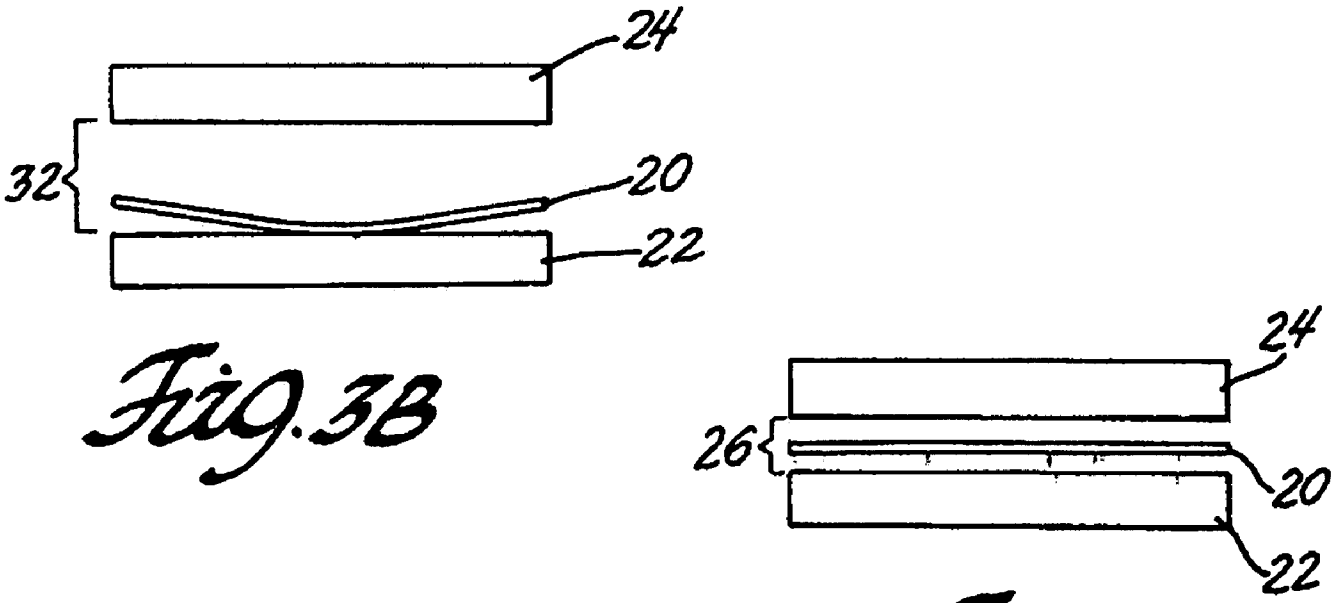
Fig.3C
Fig.3B
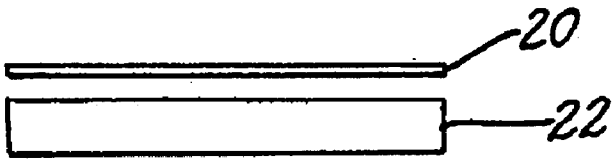
Fig.3D

CONDUCTION PREHEATING FOR HOT-FORMED SHEET METAL PANELS

TECHNICAL FIELD

This invention pertains to the heat treatment of metal sheets preparatory to hot stretch forming of the metal. More specifically, the invention relates to an improved method of using closely spaced heated platens to rapidly heat a cold worked metal alloy sheet by conduction under controlled conditions to recrystallize the sheet and for forming into an article with a high quality surface finish.

BACKGROUND OF THE INVENTION

Body panels for automotive vehicles are currently being manufactured using a hot stretch forming process applied to certain superplastically formable magnesium-containing aluminum alloy sheet stock. Examples of suitable forming practices are disclosed in U.S. Pat. No. 6,253,588 titled Quick Plastic Forming of Aluminum Alloy Sheet Metal; U.S. Pat. No. 6,880,377 titled Method for Double Action Gas Pressure Forming Sheet Metal; and U.S. Pat. No. 6,886,383 titled Method for Stretch Forming Sheet Metal by Pressing and the Application of Gas Pressure. Each of these patents is assigned to the assignee of this invention.

At the present time, the sheet stock that is used as a starting material is a fine grain microstructure, aluminum alloy 5083 having superplastic forming properties. Initially, the alloy is cast into a slab of a suitable thickness and subjected to a homogenizing heat treatment. The slab is then gradually reduced in thickness by a series of hot rolling operations to a strip in the range of twenty to forty millimeters depending somewhat on the goal for the final thickness of the sheet. The strip is cold rolled, usually in stages with interposed anneals, to a final sheet thickness in the range of about one to three or four millimeters. The result of such thermomechanical processing is a coil of smooth surface, aluminum sheet stock, the microstructure of which has been severely strained.

If this aluminum sheet stock is ultimately to be formed into automotive vehicle external body panels, or the like, the smooth surface of the cold rolled sheet is very important. The cold rolled surface must be free of visual defects and that surface quality must be retained in subsequent heating, forming and finishing steps so that the visible surface of the final part is commercially acceptable. In automotive manufacturing such a surface is called a "Class A surface."

U.S. Pat. No. 6,890,394, Heating of Metal Alloy Sheet by Thermal Conduction, assigned to the assignee of this invention, discloses practices for conductive heating of cold rolled sheets of superplastic-type metal alloys between heated platens to recrystallize the microstructure of the sheets for hot stretch forming into automotive body panels or other articles of manufacture.

The process starts with a metal sheet blank of thickness and outline for hot stretch forming of a part. In a preferred embodiment, a blank of highly strained, cold rolled AA5083 composition is placed one-side-down on a flat surface of an electrical resistance heated platen and an opposing heated platen is brought into closely spaced relation to the topside of the blank. The blank is heated by conductive heat transfer from the hot platens to rapidly recrystallize its highly strained microstructure to a softened fine-grain structure. The heating also raises the temperature of the sheet material to a suitable stretch forming temperature. The platens are separated and the hot softened sheet moved to a nearby hot stretch forming apparatus with one or more forming tool surfaces against which the sheet is pressed into a body panel or other article. Indeed, the time requirements of the thermally conductive pre-heating step on the blank and the hot stretch forming of the blank are quite similar, facilitating efficient manufacturing. The disclosed conductive annealing method can be practiced so that the formed articles retain a surface finish like the cold rolled starting material.

The full disclosure of the '394 patent is incorporated into this specification by reference.

Annealed (recrystallized) blanks formed by the '394 process typically retain the high quality visible surfaces of the cold-rolled starting material. However, it has been found that some formed parts, depending upon their shape and amount of deformation, display spaced visible bands or stripes on low-strain areas of the article. The stripes are visible after stoning the surface of the formed part or after painting the part. The surface effect on formed articles has been termed "zebra stripes" because of the generally parallel, spaced pattern of the stripes. The stripes do not appear on all parts, and when they appear they are most commonly found in an area of a formed sheet that has experienced little or no deformation. The stripes are not associated with pronounced surface contours on the article and can be removed by abrasive sanding or other surface smoothing processes. However, it is preferable to avoid formation of the stripes.

The presence of zebra stripes has been attributed to the conductive heating and subsequent forming of some blanks. It is an object of this invention to provide a modified conductive heating practice for the blank sheets to eliminate the presence of zebra stripes on surfaces of formed parts.

SUMMARY OF THE INVENTION

Usually, two internally heated platens are used in heat-treating sheet metal blanks or workpieces by thermal conduction (as described in the '394 patent). The platens are flat with surfaces large enough to sandwich the blank. They are preferably heated with several strategically located resistance heater rods so that temperatures of the platen surfaces (and selected regions) can be thermostatically controlled. When cold rolled AA5083 sheets, for example, are to be recrystallized for hot stretch forming the platen surfaces are typically maintained at temperatures in the range of 900° F. to about 950° F. Complementary, opposing upper and lower platens, opened and closed along a vertical axis, facilitate mechanical insertion of an unheated blank between, for example, a fixed lower platen and a movable upper platen for placement on the hot surface of the lower platen. The upper platen is then lowered close to the upper surface of the sheet metal for rapid heating by thermal conduction and recrystallization of the aluminum alloy blank.

The thickness of the blank sheets is often in the range of one to two millimeters (more broadly, 1–4 mm). The process has been practiced by spacing the "closed" platens so that the gap between them is about one half millimeter to about one millimeter greater that the thickness of the unheated blank. In general, such platen spacing permits the blank to expand as it is heated without marring its surfaces. And the gap is small enough for rapid conductive heating of the blank from ambient temperature to about 900° F. During such heating, the microstructure of the sheet material transforms from elongated, cold-rolled strained grains to equiaxed fine grains for high strain rate, high elongation forming into a sheet metal article.

Despite best efforts at temperature control and spacing of the platens, it is likely that the sheet is not heated uniformly and can expand and buckle locally into non-uniform contact with platen surfaces. This heat-induced movement of portions of the constrained blank may cause unintended working of the blank that affects its subsequent forming characteristics.

The practice of the invention is based on a premise that the cold rolled blank should be allowed to expand with minimal constraint during the initial stage of heating when there may be maximum gradients of temperature and flow stress in the heating blank. To minimize physical constraint, heating is imposed for a period of time before both platens are brought into close contact with the surfaces of the sheet. Generally, the method of the invention is practiced as part of a continuous process starting with a blank of cold rolled metal sheet and ending with a finished sheet metal part such as a vehicle body panel.

For example, in a continuous manufacturing operation, sheet metal blanks have been cut from a coil of cold rolled AA5083 alloy sheet material of specified thickness into a shape or profile suitable for hot forming of a desired article. Each blank is then heated to a suitable hot forming temperature during which time its microstructure is softened and recrystallized. The hot blank is carefully transferred to the hot stretch forming press in which it is shaped into a desired configuration. In accordance with this invention, the surface quality of the cold rolled material is retained through the heating and forming steps.

The sheet metal blank, usually at ambient temperature, is placed on a lower heated platen which commences rapid heating by thermal conduction through one side of the sheet. The upper platen is brought into close proximity to the upper side of the sheet but spaced so that thermally induced expansion or movement of the sheet does not bring it into contact with the upper platen. For example, a platen spacing of about 4 to 10 mm greater than the thickness of the sheet is suitable. This positioning of the platens is maintained until the hard sheet metal has undergone sufficient thermal expansion in the free state that subsequent close contact between the upper and lower platens does not work or deform the sheet. This is the first stage of the thermal pretreatment of the blank.

The platens are then brought closer together so that the spacing between the platens is, for example, no more than about one-half to about three millimeters greater than the original thickness of the blank. The temperature of the platens is controlled to anneal the sheet material and raise it to a predetermined forming temperature. With the platens closed closely about the sheet, heating progresses rapidly and completes the second stage of the heat treatment. The platens are then separated for careful removal of the soft sheet to the forming tools.

It is found that by heating the blank in the first stage, principally with just one platen contacting one surface of the sheet, the material thermally expands to a degree consistent with its average temperature so that it has low gradients of flow stress between local areas of the sheet so that when it is later contacted with the second platen there is no deformation of the sheet that shows up as zebra stripes in the formed article. In the example of thermal conduction heating of AA5083 blanks about 1.3 mm thick it is suitable to heat the blank to about 500° F. before closing the platens about the blank. The blank is then further heated with closed platens to about 900° F. to complete recrystallization and soften it for stretch forming.

Other objects and advantages of the invention will become apparent from a description of preferred embodiment which follows.

BRIEF DESCRIPTION OF THE DRAWINGS

FIG. 3B is a schematic side view of the blank being heated on the lower platen in the first stage, unconstrained blank heating stage of the process of this invention.

FIG. 3C is a schematic side view of the second stage, rapid heating of the blank with the platens closed on the blank.

FIG. 3D is a side view of the heated blank on the lower platen after separation from the upper platen.

DESCRIPTION OF PREFERRED EMBODIMENTS

Figure 2:
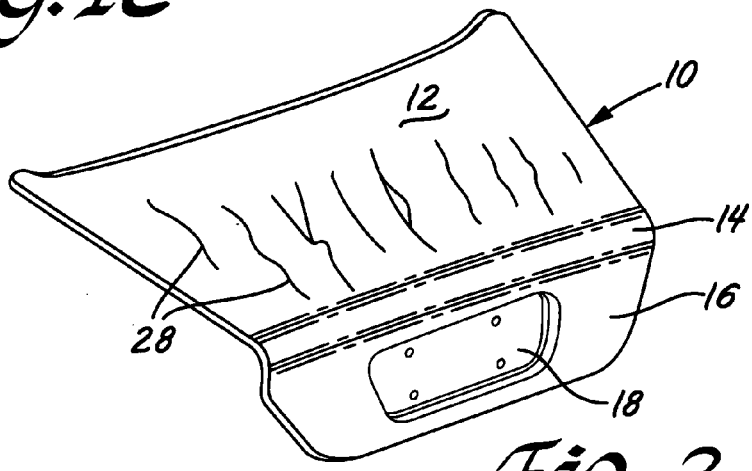
FIG. 2 is an oblique view of the upper surface of an automotive deck lid outer panel with schematic illustration of the zebra stripe effect on its upper horizontal surface.

Automobile deck lid outer panels like that illustrated at 10 in FIG. 2 are made by hot stretch forming of AA5083 sheet material. AA5083 has a nominal composition, by weight, of about 4 to 5 percent magnesium, 0.3 to 1 percent manganese, a maximum of 0.25 percent chromium, about 0.1 percent copper, up to about 0.3 percent iron, up to about 0.2 percent silicon, and the balance substantially all aluminum. Illustrative forming processes are described in patents identified above in this specification.

The formed panel comprises a mildly convex curved closure portion 12 that lies generally horizontally on a vehicle, a curved portion 14, and a vertical closure portion 16. In this example, vertical portion 16 has an integrally formed pocket 18 for a license plate. The formed panel may also have flanges at its side edges, not illustrated in FIG. 2, for use in attachment of a separately formed inner deck lid panel.

Panels like outer deck lid panel 10 may be formed starting with cold rolled AA5083 sheet material that has a high quality smooth surface for painting to constitute the outer surface of the deck lid, which is shown in FIG. 2. The cold rolled sheet material (H18 temper condition) has a uniform thickness of, for example, 1.3 mm and good surfaces, but it is hard and not suitably formable to be transformed into a suitable automotive panel. A sheet metal blank of suitable shape for forming a panel may be cut from a roll of cold rolled aluminum alloy but the metallurgical microstructure of the blank must be recrystallized to very fine grains and the sheet heated to about 900° F. so that the sheet can be stretch formed into the designer's intended shape of a body panel. The heating and forming steps are done in sequence on adjacent equipment and, preferably, each step can be completed in about the same period of time.

Figure 1A:
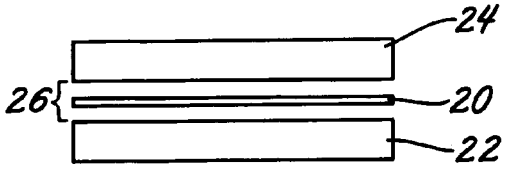
FIG. 1A is a schematic side view of upper and lower conduction heating platens just after closing on a cold rolled sheet metal blank.

FIG. 1A schematically illustrates thermal conduction heating of a flat blank 20 of cold rolled AA5083 between an electrical resistance heated lower platen 22 and an electrical resistance heated upper platen 24. The temperature of each platen 22, 24 may be individually controlled at temperatures, for example, of about 900° F. As described in the '394 patent, the blank 20 at ambient temperature is laid on the upper surface of hot lower platen 22. The lower platen 22 and blank 20 are then brought close to the hot upper platen 24, such as by raising the lower platen. When the nominal thickness of sheet 20 is 1.3 mm the spacing 26 of the hot platens 22, 24 is suitably about 2 mm. It is recognized and intended that the blank 20 will be rapidly heated, mainly by thermal conduction, between the closely spaced platens 22, 24. The blank 20 can typically be heated to about 900° F. and recrystallized in a period of 90 seconds or so, commensurate with a required time for hot stretch forming of the previously heated blank into a body panel FIG. 1A illustrates a slight, but exaggerated, spacing between the blank 20 and the much more massive heating platens 22, 24. The illustrated spacing is to permit some growth and flexing of blank 20 as heat flows to it from the platens 22, 24. After the predetermined heating period the lower platen 22 and blank 20 are separated from the upper platen 24 and the now softened blank 20 is carried by robot arms or the like to the open forming press and tooling.

Sometimes panels are formed with visible bands or stripes (illustrated schematically at 28 in FIG. 2) on portions of a panel 10. Such bands are particularly prominent in portions of the panel, which have experienced little or no deformation or elongation. Closure area 12 of the deck lid panel 10 experiences some curving or banding but little stretching. For the deck panel 10, the stripes 28 are generally parallel and of comparable length, like zebra stripes. Irregular striped patterns have been observed for other panel configurations. Although the structure of the panel is of sound quality, the stripes 28 are normally unacceptable in visible areas of an article because although they are very subtle on a formed panel, they can be observed as irregularities on a class A painted surface.

Figure 1B:
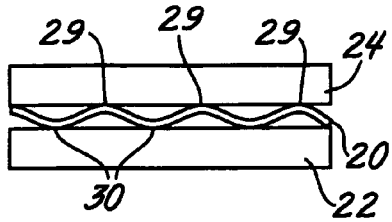
FIG. 1B is a side view of a concept of the response of the blank as it is being heated between the closed platens.

It is now believed that the stripes are formed because of deformation of the blank during early stages of its heating between closely spaced platens. This concept is illustrated schematically in FIG. 1B. When the source of the blank material is cold rolled sheet, the blank is hard and resistant to easy elongation. When the blank 20 is placed on the lower platen 22, one side of the blank engages the platen surface. Heat is rapidly transferred to the blank tending to make it lengthen. But surface contact with the platen inhibits simple flat elongation of the blank 20. The surface contact of the blank 20 with lower platen 22 and the close proximity of the upper platen 24 causes waves to be formed in the sheet metal blank as illustrated in FIG. 1B by peaks 29 and valleys 30. Although the blank 20 is being heated and tending to soften the peaks 29 rise to engage the surface of the closely spaced upper platen 24 as depicted in FIG. 1B. This unintended forceful contact of the growing sheet with the enclosing platens 22, 24 causes deformed bands to be formed in the blank 22. The deformed bands likely correspond to the locations at the peak 29 and valley 30 contact bands with the platens. The formation of locally deformed bands is promoted by local thermal gradients across the face of the heating sheet blank 22, that is the areas of direct contact between the peaks 29 and valleys 30 of the sheet and the platens 22, 24 are hotter and softer than the areas of the sheet between such contact points. Hence, the expanding sheet tends to deform preferentially on the softest areas when it is constrained from free expansion. These deformed bands remain in the blank as it is transferred to the forming press and tools. To the extent that these bands are not removed in the stretch forming of a part they may remain as visible zebra stripes 28 in the formed part 10.

Whatever the cause of the stripes, it is found that their formation, if and when they actually occur, can be avoided in accordance with this invention by the following method, which is described with reference to FIGS. 3A–3D.

Figure 1C:
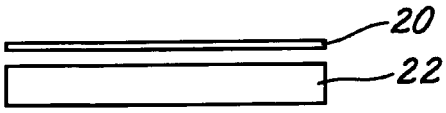
FIG. 1C is a side view of the heated blank on the lower platen after separation from the upper platen.
Figure 3A:
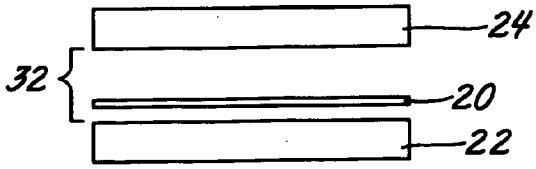
FIG. 3A is a schematic side view of the blank just applied to the lower heating platen and showing the relative position of the upper platen at the start of the heating.

Preheated platens 22 and 24 are used as in the process described with reference to FIGS. 1A and 1C. Cold rolled blank 20 is placed on the upper surface of heated lower platen 22 as shown in FIG. 3A. Lower platen 22 and blank 20 are brought within several millimeters of upper platen 24, for example, to a platens spacing that is about 4–10 mm greater than the thickness of the blank. The spacing (indicated at 32 in FIGS. 3A and 3B) between is such as to promote heating of blank 20 without permitting upper platen 24 to engage blank 20 as it grows and warps (shown schematically by the bowl-like curvature in blank 20 in FIG. 3B) under intense heat from the platens 22, 24. For example, the magnitude of spacing 32 may be about five to eleven millimeters when the thickness of the blank 20 is about 1.3 mm. Spacing 32 of platens 22, 24 is maintained for a period of seconds until blank 20 has undergone sufficient thermal expansion in the free state (not contacting platens 22 and 24 simultaneously) that subsequent close contact between the platens 22, 24 does not cause mechanical working of the blank 20. In the case of a cold rolled AA5083 bank it may be preferred to heat the blank to about 500° F. before the platen spacing is reduced to close spacing 26 as illustrated in FIGS. 1A and 3C. In other words, the wider platen spacing is maintained until the blank has thermally expanded sufficiently so that it is not deformed plastically as it continues to be heated by the more closely spaced positioning of platens 22, 24. After the AA5083 blank has reached a temperature of about 900° F., the platens 22, 24 are opened and blank 20 is removed from platen 22 and moved to the forming apparatus.

Thus, in accordance with the present invention, conduction heating of a work hardened sheet metal blank, preparatory to hot forming, is conducted in two stages. In the first heating stage the blank is in full contact with one platen for heating by thermal conduction. The other platen is spaced to contribute to the rapid heating of the platen but to avoid squeezing contact or deforming contact with the warming blank as it expands on and from the first platen. In the case of a blank that is about 1–1.5 mm thick the platen spacing may be, for example, about 5–11 mm, or 4–10 mm greater than the thickness of the blank. This first stage spacing of the platens and the duration of such spacing may be determined experimentally to avoid the formation of zebra stripes in any particular article or panel. After the blank has been partially heated so as to experience fairly uniform thermal expansion and to become softened nearly uniformly throughout its volume so that it can be constrained or bent without preferentially working local areas, the platens are brought closer together about the blank to complete its softening and heating for forming.

Practices of the invention have been illustrated by some examples. But the scope of the invention is not limited by these illustrations.

The invention claimed is:

1. A method of forming a sheet of superplastically formable, metal alloy composition comprising:

providing a cold worked sheet of the alloy composition;

controlling the temperatures of a pair of opposing heated platens to recrystallize the cold worked microstructure of the metal sheet to a fine grained microstructure for superplastic forming; the platens being movable between an open position for receiving a sheet and a closed position for conductive heating of the sheet with one side surface of the sheet facing one platen and the opposite side surface of the sheet facing the opposing platen;

placing a side surface of the sheet against one platen for first stage heating of the sheet to a thermally expanded and softened condition in which it will not be mechanically deformed by contact with the opposing platen, the first stage heating being accomplished with the platens in a position other than their closed position;

moving the platens and sheet to the closed position of the platens for second stage heating of the softened sheet by conductive heat transfer to its side surfaces to recrystallize the cold worked microstructure of the meal sheet to a fine grained microstructure for superplastic forming;

removing the sheet from between the platens; and forming the heated sheet.

2. A method as recited in claim 1 in which said sheet is of a superplastically formable aluminum alloy composition.

3. A method as recited in claim 1 in which said sheet is of a superplastically formable, magnesium containing aluminum alloy composition.

4. A method as recited in claim 3 in which the sheet has experienced a cold work reduction to a H18 temper state.

5. A method as recited in claim 1 in which the platens and sheet are moved to a closed position for second stage heating of the softened sheet in which the platens form a gap with the side surfaces of said sheet, the gap being sized and shaped to complete heating of the sheet by conductive heat transfer through said gap from each platen through the facing side surfaces of said sheet and such that the gap is no greater than about three millimeters plus the thickness of said sheet.

6. A method of forming a sheet of superplastic formable, metal alloy composition comprising:

providing a cold worked sheet of the alloy composition;

controlling the temperatures of a pair of opposing heated platens to recrystallize the cold worked microstructure of the metal sheet to a fine grained microstructure for superplastic forming; the platens being movable between an open position for receiving a sheet and a closed position for conductive heating of the sheet with one side surface of the sheet facing one platen and the opposite side surface of the sheet facing the opposing platen;

placing a side surface of the sheet against one platen for first stage heating of the sheet to a thermally expanded and softened condition in which it will not be mechanically deformed by contact with the opposing platen; moving the platens and sheet during first stage heating to a position, between the open and closed positions, to increase the rate of heating of the sheet from both of its sides to its expanded and softened condition;

moving the platens and sheet to the closed position of the platens for second stage heating of the softened sheet by conductive heat transfer to its side surfaces to recrystallize the cold worked microstructure of the meal sheet to a fine grained microstructure for superplastic forming;

removing the sheet from between the platens; and forming the heated sheet.

7. A method of forming a sheet of superplastic formable, metal alloy composition as recited in claim 6 in which the platens comprise a lower platen with a horizontal heating surface and an upper platen with an opposing horizontal heating surface, and the sheet is placed on the heating surface of the lower platen.

8. A method of forming a sheet of superplastic formable, metal alloy composition as recited in claim 6 in which the spacing between the platens during first stage heating is in the range of about four millimeters to about ten millimeters plus the thickness of the sheet.

9. A method as recited in claim 6 in which the platens and sheet are moved to a closed position for second stage heating of the softened sheet in which the platens form a gap with the side surfaces of said sheet, the gap being sized and shaped to complete heating of the sheet by conductive heat transfer through said gap from each platen through the facing side surfaces of said sheet and such that the gap is no greater than about three millimeters plus the thickness of said sheet.

10. A method of forming a sheet of superplastic formable, magnesium containing, aluminum alloy composition comprising:

providing a cold worked sheet of the alloy composition;

controlling the temperatures of upper and lower opposing heated platens to recrystallize the cold worked microstructure of the metal sheet to a fine grained microstructure for superplastic forming; the platens having horizontal heating surfaces and at least one platen being movable vertically between an open position for receiving a sheet and a closed position for conductive heating of the sheet with one side surface of the sheet facing one platen and the opposite side surface of the sheet facing the opposing platen;

placing the sheet on the lower platen for first stage heating of the sheet to a thermally expanded and softened condition in which it will not be mechanically deformed by contact with the opposing platen;

moving the platens and sheet during the first stage of heating to a first position, between the open and closed positions, to increase the rate of heating of the sheet from both of its sides to its softened condition;

moving the platens and sheet to the closed position of the platens for second stage heating of the softened sheet by conductive heat transfer to its side surfaces to recrystallize the cold worked microstructure of the meal sheet to a fine grained microstructure for superplastic forming;

removing the sheet from between the platens; and forming the heated sheet.

* * * * *